US010787987B2

(12) United States Patent
Dölker

(10) Patent No.: US 10,787,987 B2
(45) Date of Patent: Sep. 29, 2020

(54) CONTROLLING A PRESSURE REGULATING VALVE OF A FUEL RAIL

(71) Applicant: MTU FRIEDRICHSHAFEN GMBH, Friedrichshafen (DE)

(72) Inventor: Armin Dölker, Friedrichshafen (DE)

(73) Assignee: MTU FRIEDRICHSHAFEN GMBH, Friedrichshafen (DE)

( * ) Notice: Subject to any disclaimer, the term of this patent is extended or adjusted under 35 U.S.C. 154(b) by 0 days.

(21) Appl. No.: 15/122,830

(22) PCT Filed: Jun. 26, 2015

(86) PCT No.: PCT/EP2015/001303
§ 371 (c)(1),
(2) Date: Aug. 31, 2016

(87) PCT Pub. No.: WO2016/008565
PCT Pub. Date: Jan. 21, 2016

(65) Prior Publication Data

US 2017/0067409 A1 Mar. 9, 2017

(30) Foreign Application Priority Data

Jul. 14, 2014 (DE) ..... 10 2014 213 648

(51) Int. Cl.
*F02M 63/02* (2006.01)
*F02D 41/38* (2006.01)
(Continued)

(52) U.S. Cl.
CPC ..... *F02D 41/3863* (2013.01); *F02D 41/22* (2013.01); *F02D 41/3845* (2013.01);
(Continued)

(58) Field of Classification Search
CPC .. F02D 41/3863; F02D 41/22; F02D 41/3845; F02D 2041/1418;
(Continued)

(56) References Cited

U.S. PATENT DOCUMENTS 7,574,994 B2 * 8/2009 Scheurer ..... F02M 55/002 123/447
7,779,819 B2 8/2010 Serra et al.
(Continued)

FOREIGN PATENT DOCUMENTS

DE 102009031527 B3 11/2010
DE 102009031528 B3 11/2010
(Continued)

*Primary Examiner* — Hai H Huynh
*Assistant Examiner* — Gonzalo Laguarda
(74) *Attorney, Agent, or Firm* — Lucas & Mercanti, LLP; Klaus P. Stoffel

(57) ABSTRACT

A method for operating an internal combustion engine having an injection system which has a high-pressure accumulator, wherein a high pressure in the high-pressure accumulator is regulated via a suction throttle on the low-pressure side as a first pressure control member in a first high-pressure control loop, wherein in a normal operation a high-pressure disturbance variable is produced via a pressure control valve on the high-pressure side as a second pressure control member, via which fuel is redirected from the high-pressure accumulator to a fuel reservoir. For this purpose, the high pressure in a safety operation is regulated by the pressure control valve via a second high-pressure control loop, or, in the safety operation, a maximum fuel volume flow is continuously redirected from the high-pressure accumulator to the fuel reservoir via the pressure control valve.

9 Claims, 5 Drawing Sheets

(51) Int. Cl.
*F02D 41/22* (2006.01)
*F02M 59/46* (2006.01)
*F02D 41/14* (2006.01)

(52) U.S. Cl.
CPC ..... *F02M 59/46* (2013.01); *F02M 63/023* (2013.01); *F02D 2041/1418* (2013.01); *F02D 2041/223* (2013.01); *F02D 2041/226* (2013.01); *F02D 2200/0802* (2013.01); *F02M 63/025* (2013.01); *F02M 63/0225* (2013.01); *F02M 2200/40* (2013.01)

(58) Field of Classification Search
CPC ..... F02D 2041/223; F02D 2041/226; F02D 2200/0802; F02D 2200/40; F02D 41/3854; F02M 59/46; F02M 63/023; F02M 63/025; F02M 63/026
USPC ..... 701/107; 123/456, 457, 459, 479, 510, 123/511, 198 D; 73/114.38, 43
See application file for complete search history.

(56) References Cited

U.S. PATENT DOCUMENTS

| | | | | |
|---|---|---|---|---|
| 8,511,284 | B2 * | 8/2013 | Matsuki | F02D 41/06 123/458 |
| 8,855,889 | B2 | 10/2014 | Dölker | |
| 9,328,689 | B2 | 5/2016 | Dölker | |
| 9,410,498 | B2 * | 8/2016 | Riepl | F02D 41/3845 |
| 2012/0097131 | A1 | 4/2012 | Dölker | |
| 2012/0097134 | A1 | 4/2012 | Dölker | |

FOREIGN PATENT DOCUMENTS

| | | | |
|---|---|---|---|
| DE | 102009031529 | B3 | 11/2010 |
| DE | 102009050467 | A1 | 4/2011 |
| DE | 102013203490 | A1 | 5/2014 |
| EP | 2011997 | A1 | 1/2009 |

* cited by examiner

CONTROLLING A PRESSURE REGULATING VALVE OF A FUEL RAIL

The present application is a 371 of International application. PCT/EP2015/001303, filed Jun. 26, 2015, which claims priority of DE 10 2014 213 648.2, filed Jul. 14, 2014, the priority of these applications is hereby claimed and these applications are incorporated herein by reference.

BACKGROUND OF THE INVENTION

The invention relates to a method for operating an internal combustion engine, to an injection system for an internal combustion engine, and to an internal combustion engine.

The German patent DE 2009 031 529 B3 has disclosed a method for operating an internal combustion engine having an injection system, wherein the injection system has a common high-pressure accumulator, specifically a so-called rail, such that the injection system is in the form of a common-rail system. A high pressure in the high-pressure accumulator is regulated by way of a low-pressure-side suction throttle as a first pressure setting element in a high-pressure regulating loop. A high-pressure disturbance variable is generated by way of a high-pressure-side pressure regulating valve as a second pressure setting element, wherein, by way of the pressure regulating valve, fuel is discharged from the high-pressure accumulator into a fuel reservoir. Here, it is provided that, when a protective function is set, the pressure regulating valve is temporarily actuated to a maximum extent in an opening direction. The protective function is set if a dynamic high pressure overshoots a predefined pressure threshold value. By virtue of the pressure regulating valve being actuated in the direction of maximum opening, a further increase of the rail pressure can be temporarily prevented. After a predefined time period expires, the protective function is reset. Setting of the protective function again is possible only if the predefined pressure threshold value is overshot again, wherein the protective function is simultaneously re-enabled. The enablement is effected by way of a specific variable which is set to an enable value only when the high pressure falls below a predefined hysteresis threshold value after the protective function has been activated and subsequently reset.

In the case of this actuation of the pressure regulating function, there is the disadvantage that the protective function is periodically activated for example in the event of a cable breakage of the suction throttle plug connector, if use is made of a suction throttle which is open when deenergized. In this case, the suction throttle is specifically operated permanently in an open state, whereby a maximum fuel quantity is delivered into the high-pressure accumulator, said fuel quantity being higher the higher the engine speed of the internal combustion engine. This leads to an increase of the high pressure, which is stopped when the pressure regulating valve opens. Since the protective function is however only temporarily active, the high pressure initially falls and rises again when the protective function is reset, because there is a continuous follow-up delivery of fuel via the suction throttle. As a result, the protective function is reactivated, whereby the rail pressure falls again, wherein the pattern discussed here subsequently repeats periodically. The result is a periodically fluctuating high pressure, which leads to unsettled engine running. Furthermore, the emissions characteristics of the internal combustion engine are impaired, because, when the protective function responds, the high pressure is no longer regulated and can thus deviate significantly from an intended setpoint value.

It is also the case that the known injection system has a mechanical pressure relief valve which, when a further, typically higher pressure threshold value is overshot, opens and thus reliably prevents, in purely mechanical fashion, an inadmissibly high pressure rise in the high-pressure accumulator independently of an electronic actuation. Aside from the pressure relief valve itself, lines must be provided which connect said pressure relief valve at one side to the high-pressure accumulator and at the other side to the fuel reservoir. Said parts require structural space and contribute to the costs of the injection system. It is therefore desirable to be able to omit the pressure relief valve and the lines connected thereto.

SUMMARY OF THE INVENTION

It is an object of the invention to provide a method which does not have at least one of the stated disadvantages. In particular, with the aid of the method, it should be possible to reliably protect the internal combustion engine against an inadmissible rise of the high pressure and, where possible, to simultaneously ensure a stable high pressure for improved emissions characteristics of the internal combustion engine. The invention is also based on the object of providing a corresponding injection system and an internal combustion engine.

The object is achieved through the provision of a method for operating an internal combustion engine in which, in a first embodiment of the method, it is provided that, in a protective operating mode, the high pressure is regulated by means of the pressure regulating valve by way of a second pressure regulating loop. This yields the following: in a normal operating mode, the high pressure in the high-pressure accumulator is regulated by way of the low-pressure-side suction throttle as a first pressure setting element in a first high-pressure regulating loop, wherein, the normal operating mode, a high-pressure disturbance variable is generated as a second pressure setting element by way of the pressure regulating valve. By contrast, in the protective operating mode, the high pressure is regulated by means of the pressure regulating valve by way of the second pressure regulating loop. In this way, it can be provided that regulation of the high pressure remains possible, specifically by way of the second high-pressure regulating loop and by way of the pressure regulating valve, even in the event of a failure of the first high-pressure regulating loop—in particular in the event of a failure of the suction throttle as first pressure setting element, for example owing to a cable breakage, a failure to remember to connect the suction throttle plug connector, jamming of or an accumulation of dirt on the suction throttle, or some other fault or defect in the first high-pressure regulating loop. Firstly, it is thus possible for the injection system to be protected against an inadmissibly high pressure, and secondly, a periodic fluctuation of the high pressure is prevented. Said high pressure is rather regulated by way of the second high-pressure regulating loop to its setpoint value, such that no impairment of the emissions characteristics of the internal combustion engine occurs.

Also preferred is a second embodiment of the method which is characterized in that the pressure regulating valve is permanently opened in a protective operating mode. This means in particular that a large, preferably maximum fuel volume flow is constantly discharged from the high-pressure accumulator into the fuel reservoir by way of the pressure regulating valve. That is to say, in particular, that in the protective operating mode, the pressure regulating valve is actuated in the direction of opening to a maximum extent. It is particularly preferable for the pressure regulating valve to be opened to a maximum extent in the protective operating mode. Depending on whether the pressure regulating valve is designed to be open when deenergized or closed when deenergized, said pressure regulating valve is in this case preferably actuated with a high, preferably maximum actuation current, or actuated with a low actuation current, preferably not energized. The fuel volume flow that actually passes through the pressure regulating valve here is self-evidently dependent on the high pressure in the high-pressure accumulator, wherein the expression "maximum fuel volume flow" refers to a situation in which the pressure regulating valve is opened to the maximum extent. In this embodiment, an inadmissibly high high pressure in the high-pressure accumulator is rapidly and reliably dissipated not only temporarily but permanently, such that the injection system is protected in an effective and reliable manner.

In the context of the method, the use of a mechanical pressure relief valve is preferably dispensed with. It is thus preferably the case in particular that a mechanical pressure relief valve is no longer used. Here, owing to the reliable and effective protection of the injection system against an inadmissibly high high pressure in the protective operating mode, it is possible to omit the mechanical pressure relief valve, such that the structural space associated with said pressure relief valve and with the corresponding lines can be saved, wherein costs for the injection system are also eliminated, such that said injection system can thus be of altogether more inexpensive design.

An embodiment of the method is preferred in which the first and the second embodiment are combined with one another such that they are realized in addition to one another. This embodiment of the method is accordingly characterized in that, in a first operation type of the protective operating mode, the high pressure is regulated by means of the pressure regulating valve by way of the second high-pressure regulating loop, wherein, in a second operation type of the protective operating mode, the pressure regulating valve is permanently opened, wherein it is preferably the case that a maximum fuel volume flow is constantly discharged from the high-pressure accumulator into the fuel reservoir by way of the pressure regulating valve. It is advantageous here that, in the first operation type of the protective operating mode, regulation of the high pressure remains possible, wherein, in the second operation type, safe and reliable prevention of an inadmissibly high high pressure in the high-pressure accumulator is permanently ensured. Here, it is preferably provided that the first operation type of the protective operating mode is realized if the high pressure lies between a first, relatively low pressure threshold value and a second, relatively high pressure threshold value, wherein stable regulation of the high pressure remains possible in said pressure range, wherein the second operation type is realized in a pressure range above the second, relatively high pressure threshold value, in which pressure range, without discharging of the fuel volume flow from the high-pressure accumulator into the fuel reservoir, damage would be caused to the injection system by an inadmissibly high pressure. In this case, the first operation type permits pressure regulation for example even in the event of a failure of the first high-pressure regulating loop, wherein the second operation type ensures safe and reliable protection of the injection system in the event of an inadmissibly high pressure rise, such that it is possible in particular to dispense with a mechanical pressure relief valve.

The high-pressure accumulator is preferably in the form of a common high-pressure accumulator to which a multiplicity of injectors is fluidically connected. A high-pressure accumulator of said type is also referred to as a rail, wherein the injection system is preferably in the form of a common-rail injection system.

An embodiment of the method is preferred which is characterized in that a first operation type of the protective operating mode is set if the high pressure reaches or overshoots a first pressure threshold value. Here, in the first operation type, the pressure regulating valve performs the regulation of the high pressure. The first operation type discussed here thus corresponds to the first operation type of the protective operating mode as discussed above, wherein the embodiment discussed here may be realized regardless of whether or not a second operation type also actually exists. In this respect, the term "first operation type" used here serves merely for distinction from the operation type referred to as "second operation type", wherein it is not imperatively necessary for both operation types to be provided. By virtue of the first operation type being set when the high pressure reaches or overshoots the first pressure threshold value, it is ensured that said operation type is activated whenever—and preferably only when—a malfunction occurs in the first high-pressure regulating loop. For this purpose, the first pressure threshold value is preferably selected so as to be higher than a maximum pressure value for the high pressure that is typically realized during fault-free operation of the injection system. In the case of a specific injection system of a specific internal combustion engine, it is for example typically possible for the high pressure to be regulated to a value of 2200 bar during operation. Here, a pressure reserve is provided for any occurring pressure fluctuations up to 2300 bar. In this case, the first pressure threshold value is preferably selected to be 2400 bar in order to prevent the first operating mode being activated without a malfunction of the first high-pressure regulating loop being present. If such a malfunction however occurs—for example a cable breakage in the suction throttle plug connector, jamming of the suction throttle, an accumulation of dirt on said suction throttle, or a failure to remember to connect the suction throttle plug connector—the high pressure may, in particular in a relatively high engine speed range of the internal combustion engine, rise above the provided reserve level, in particular if the suction throttle is designed to be open when deenergized. In this case, the high pressure reaches or overshoots the first pressure threshold value, and the pressure regulating valve performs the regulation of the high pressure. Then, despite failure of the first high-pressure regulating loop, stable regulation of the high pressure remains possible, such that no impairment of the emissions characteristics of the internal combustion engine occurs, wherein said internal combustion engine is at the same time reliably protected against an inadmissible rise of the high pressure.

For comparison with the first pressure threshold value, use is preferably made of a dynamic rail pressure which results from a filtering, in particular with a relatively short time constant, of the high pressure measured by way of a high-pressure sensor. It is however alternatively also possible for the measured high pressure to be compared directly with the first pressure threshold value. By contrast, the filtering has the advantage that—albeit seldomly occurring—overshoots beyond the first pressure threshold value do not lead directly to the first operation type being set.

In a preferred embodiment of the method, a control variable for the pressure regulating valve in the first operation type is limited in a manner dependent on the high pressure. This has the advantage that the pressure regulating valve is opened no further than is required for a maximum discharge that is actually expedient in the presence of a given high pressure. In this way, overloading of the pressure regulating valve can be avoided. For the limitation of the control variable, use is preferably made of a characteristic curve in which a maximum volume flow of the pressure regulating valve is stored in a manner dependent on the high pressure.

Upon a switch from the normal operating mode into the first operation type of the protective operating mode, it is the case in a preferred embodiment of the method that an integrating component of a pressure regulator of the second high-pressure regulating loop which is provided for the actuation of the pressure regulating valve is initialized with an actuation value which was used for the actuation of the pressure regulating valve during the normal operating mode immediately prior to the switchover to the protective operating mode. In this way, a smooth, disturbance-free and continuous transition in the pressure regulation between the regulation by way of the first high-pressure regulating loop in the normal operating mode and the regulation by way of the second high-pressure regulating loop in the protective operating mode is ensured. In particular, this prevents step changes in the high pressure from occurring, which would lead to unstable operation of the internal combustion engine.

An embodiment of the method is also preferred which is characterized in that a second operation type of the protective operating mode is set if the high pressure overshoots a second pressure threshold value. Here, in the second operation type, the pressure regulating valve is permanently opened, wherein it is preferably the case that a maximum fuel volume flow is permanently discharged from the high-pressure accumulator into the fuel reservoir by way of the pressure regulating valve. The second operating mode thus corresponds to the second operation type already described above, which may be provided alternatively or in addition to the first operation type. If said second operation type is provided in addition to the first operation type, the second pressure threshold value is preferably selected to be higher than the first pressure threshold value. Regardless of whether the second operation type is provided in addition or alternatively to the first operation type, the second pressure threshold value is preferably selected so as to correspond to a pressure that would be selected as an opening pressure for a mechanical pressure relief valve in the case of a conventional embodiment of the injection system. In the specific example of an injection system of an internal combustion engine discussed above in conjunction with the first operation type, the second pressure threshold value would for example be 2500 bar. This would correspond to a pressure at which, in said specific example, a mechanical pressure relief valve would be designed to open. By virtue of the fact that, in the second operation type, the pressure regulating valve discharges a large, preferably maximum fuel volume flow from the high-pressure accumulator into the fuel reservoir not only temporarily—such as is known from the prior art—but rather permanently, an inadmissible rise of the high pressure, and thus damage to the injection system, are reliably prevented by way of the pressure regulating valve. In this way, the mechanical pressure relief valve can be omitted. The function of said mechanical pressure relief valve is rather replicated entirely by way of the pressure regulating valve.

With the second pressure threshold value there is preferably compared a dynamic rail pressure which is obtained by filtering, in particular with a relatively short time constant, from the high pressure measured by way of a high-pressure sensor. It is however alternatively also possible for the measured high pressure to be compared directly with the second pressure threshold value.

In an embodiment of the method in which both the first operation type and the second operation type are realized, the following situation arises: if the first high-pressure regulating loop fails, and if as a result of this event the high pressure in the high-pressure accumulator rises, said high pressure is initially regulated in a range between the first pressure threshold value and the second pressure threshold value by way of the pressure regulating valve. Thus, stable operation of the internal combustion engine with good emissions values can still be made possible in said range. This is the case in particular in a low to medium engine speed range in which, owing to the low to medium rotational speed of the high-pressure pump itself, a fuel quantity that is still manageable by means of regulation by way of the pressure regulating valve is delivered via a fully opened suction throttle from the fuel reservoir into the high-pressure accumulator. By contrast, if the high pressure in the high-pressure accumulator rises inadmissibly high beyond the second pressure threshold value, for example in a high engine speed range of the internal combustion engine, pressure regulation is no longer possible by way of the pressure regulating valve. Said pressure regulating valve is rather then, in the second operation type, opened as fully as possible such that a large, preferably maximum fuel volume flow can be discharged into the fuel reservoir. This corresponds to the functionality of the mechanical pressure relief valve that is otherwise provided.

Here, it is possible for the first operation type and the second operation type to be implemented sequentially one after the other, wherein, for example in the event of a defect occurring in the first high-pressure regulating loop, the first operation type is realized at an initially low engine speed of the internal combustion engine, wherein, as the engine speed rises, the second operation type is finally realized. It may however also be the case that the high pressure in the high-pressure accumulator rises abruptly beyond the second pressure threshold value, wherein in this case, the first operation type is, as it were, bypassed, and the second operation type is realized immediately.

An embodiment of the method is preferred which is characterized in that, for the pressure regulating valve in the normal operating mode, a normal function is set in which the pressure regulating valve is actuated in a manner dependent on a setpoint volume flow. Here, in the normal operating mode, the normal function provides for the pressure regulating valve an operation type in which said pressure regulating valve generates a high-pressure disturbance variable by discharging fuel from the high-pressure accumulator into the fuel reservoir.

It is preferably the case that the normal function is set for the pressure regulating valve in the first operation type of the protective operating mode, too, such that the pressure regulating valve is actuated in a manner dependent on a setpoint volume flow. The normal operating mode, on the one hand, and the first operation type of the protective operating mode, on the other hand, differ in this case in terms of the manner in which the setpoint volume flow for the actuation of the pressure regulating valve is calculated:

In the normal operating mode, the setpoint volume flow is preferably calculated from a steady-state setpoint volume flow and a dynamic setpoint volume flow. The steady-state setpoint volume flow is in turn preferably calculated in a manner dependent on a setpoint injection quantity and an engine speed of the internal combustion engine by way of a setpoint volume flow characteristic map. In the case of a torque-oriented structure, it is also possible here for a setpoint torque or a setpoint load demand to also be used instead of the setpoint injection quantity. By way of the steady-state setpoint volume flow, a constant leakage is replicated by virtue of the fuel being discharged only in a low-load range and in small quantities. Here, it is advantageous that no significant increase of the fuel temperature and also no significant reduction in the efficiency of the internal combustion engine occur. Through the replication of a constant leakage for the injection system by way of the pressure regulating valve, the stability of the high-pressure regulating loop in the low-load range is increased, which is evident for example from the fact that the high pressure remains approximately constant during overrun operation. The dynamic setpoint volume flow is calculated by way of a dynamic correction in a manner dependent on a setpoint high pressure and the actual high pressure, or in a manner dependent on the regulating deviation derived therefrom. If the regulating deviation is negative, for example in the event of a load dump of the internal combustion engine, the steady-state setpoint volume flow is corrected by way of the dynamic setpoint volume flow. Otherwise, that is to say in particular in the event of a positive regulating deviation, no change in the steady-state setpoint volume flow is performed. By way of the dynamic setpoint volume flow, an increase of the high pressure is counteracted, with the advantage that the settling time of the system can be yet further improved.

This approach is described in detail in the German patent DE 10 2009 031 529 B3. The pressure regulating valve is thus, in the normal operating mode, actuated by way of the setpoint volume flow such that, by way of the replication of a constant leakage, said pressure regulating valve increases the stability of the high-pressure regulating loop and, by means of the correction by way of the dynamic setpoint volume flow, improves the settling time of the injection system.

In the first operation type of the protective operating mode, it is the case, by contrast, that the setpoint volume flow is calculated in the second high-pressure regulating loop—in particular by a pressure regulating valve pressure regulator. In this case, the setpoint volume flow constitutes a control variable of the second high-pressure regulating loop, and serves for the direct regulation of the high pressure.

It is preferable for an actuation mechanism for the pressure regulating valve to be provided, which actuation mechanism has the setpoint volume flow as input variable. It is then preferably the case that, by way of a—possibly virtual—switch, upon the switchover from the normal operating mode to the first operation type of the protective operating mode, a switchover is performed from the calculation of the setpoint volume flow as a resultant volume flow made up of the steady-state and the dynamic setpoint volume flows to the calculation in the second high-pressure regulating loop. Here, it is preferably the case that the integrating component of the pressure regulating valve pressure regulator of the second high-pressure regulating loop is, upon the switchover, initialized with the most recently calculated resultant setpoint volume flow before the switchover, such that a disturbance-free, smooth switchover is realized.

Alternatively or in addition, it is preferable that, for the pressure regulating valve in the second operation type of the protective operating mode, a standstill function is set, wherein the pressure regulating valve is not actuated in the standstill function. This is the case in particular if use is made of a pressure regulating valve which is open when deenergized. By virtue of the fact that the pressure regulating valve is then not actuated, that is to say not energized, in the standstill function, maximum opening of said pressure regulating valve is realized, such that a maximum fuel volume flow is discharged from the high-pressure accumulator into the fuel reservoir via the pressure regulating valve. In this way, the pressure regulating valve can fully perform the functionality of a mechanical pressure relief valve that is otherwise provided, such that the mechanical pressure relief valve can be dispensed with. Here, the design of the pressure regulating valve so as to be open when deenergized has the advantage that said pressure regulating valve reliably fully opens even when it is no longer energized owing to a defect.

A transition from the normal function to the standstill function is preferably performed if the high pressure, in particular the dynamic rail pressure, reaches or overshoots the second pressure threshold value, or if a defect of the high-pressure sensor is detected. If the high-pressure sensor is defective, the high pressure can no longer be regulated, and it is also no longer possible to detect an inadmissibly high pressure in the high-pressure accumulator. Therefore, in this case, for safety reasons, the standstill function is set for the pressure regulating valve, such that said pressure regulating valve opens to a maximum extent and thus places the injection system into a safe state which corresponds to a state in which, in the prior art, the mechanical pressure relief valve would be open. It is then no longer possible for an inadmissible increase of the high pressure to occur. The standstill function is preferably also set, proceeding from the normal function, if it is detected that the internal combustion engine is at a standstill. In particular if the engine speed of the internal combustion engine falls below a predetermined value for a predetermined time, it is identified that the internal combustion engine is at a standstill, and the standstill function for the pressure regulating valve is set. This is the case in particular when the internal combustion engine is shut down. A transition between the standstill function and the normal function is preferably performed, upon a start-up of the internal combustion engine, when it is detected that the internal combustion engine is running, wherein, at the same time, the high pressure overshoots a starting pressure value. It is thus preferably the case that a certain minimum build-up of pressure in the high-pressure accumulator takes place initially before the pressure regulating valve, in the normal function, is actuated for generating the high-pressure disturbance variable. The fact that the internal combustion engine is running can be identified preferably by virtue of the fact that a predetermined threshold engine speed is overshot for a predetermined time.

An embodiment of the method is also preferred which is characterized in that, in the second operation type of the protective operating mode, the suction throttle is permanently opened, preferably actuated for permanently open operation. Owing to the pressure regulating valve being opened in particular to the greatest possible extent in the second operation type, it is possible for the pressure in the high-pressure accumulator to fall to a great extent. While it is then the case in a high engine speed range of the internal combustion engine that it is nevertheless still possible to provide an adequate high pressure for the operation of the internal combustion engine, it may, in the case of the suction throttle being opened to an insufficient extent in a medium or low engine speed range, be the case that the high pressure in the high-pressure accumulator falls to such an extent that it is no longer possible for enough fuel to be injected via the injectors. In such a case, the internal combustion engine will stall. To prevent this, in the second operation type, the suction throttle is, in a type of emergency running operating mode, permanently opened, in particular actuated for permanently open operation, in order to ensure that, even in the medium and low engine speed range of the internal combustion engine, it is still possible for enough fuel to be delivered into the high-pressure accumulator in order to be able to maintain operation of the internal combustion engine. Use is preferably made of a suction throttle which is open when deenergized.

Therefore, in the second operation type, the suction throttle is preferably actuated with a low current in relation to its maximum closing current, for example with 0.5 A, or is even not actuated, that is to say not energized. Here, when not energized, said suction throttle is opened to the maximum extent.

Alternatively or in addition, in the first operation type of the protective operating mode, the suction throttle is permanently opened, preferably actuated for permanently open operation, in particular is not energized or energized with only a low current. In this way, in particular in a situation in which the first operation type is activated as a result of an overshoot of the high pressure in the case of an intact suction throttle, twofold simultaneous regulation of the high pressure both by way of the pressure regulating valve and by way of the suction throttle is prevented.

The object is also achieved through the provision of an injection system for an internal combustion engine. The injection system has at least one injector and a high-pressure accumulator, wherein the high-pressure accumulator is fluidically connected at one side to the at least one injector and at the other side via a high-pressure pump to a fuel reservoir. The high-pressure pump is assigned a suction throttle as first pressure setting element. Furthermore, the injection system has a pressure regulating valve by way of which the high-pressure accumulator is fluidically connected to the fuel reservoir. Also provided is a control unit which is operatively connected to the at least one injector, to the suction throttle and to the pressure regulating valve in order to actuate there. The injection system is characterized in that the control unit is set up for carrying out a method according to one of the embodiments described above. Thus, the advantages that have been discussed in conjunction with the method are realized in conjunction with the injection system.

The injection system preferably has a multiplicity of injectors, wherein said injection system has precisely one and only one high-pressure accumulator or alternatively two high-pressure accumulators, to which the various injectors are fluidically connected. The one or more common high-pressure accumulators is/are in this case in the form of a so-called common strip, in particular a rail, wherein the injection system is preferably in the form of a common-rail injection system.

The suction throttle is connected upstream of, in particular connected fluidically upstream of, the high-pressure pump, that is to say is arranged upstream of the high-pressure pump. Here, it is possible for the suction throttle to be integrated into the high-pressure pump or into a housing of the high-pressure pump.

On the high-pressure accumulator there is preferably arranged a pressure sensor which is set up for detecting a high pressure in the high-pressure accumulator and which is operatively connected to the control unit such that the high pressure can be registered in the control unit. The control unit is preferably set up for filtering the measured high pressure, in particular for filtering it with a first, relatively long time constant, in order to calculate an actual high pressure that is used in the context of the pressure regulation, and for filtering the measured high pressure with a second, relatively short time constant, in order to calculate the dynamic rail pressure.

Upstream of the high-pressure pump and of the suction throttle there is preferably arranged a low-pressure pump for delivering fuel from the fuel reservoir to the suction throttle and the high-pressure pump.

The control unit is preferably in the form of an engine control unit (ECU) of the internal combustion engine. It is however alternatively also possible for a separate control unit to be provided specifically for carrying out the method.

An exemplary embodiment of the injection system is preferred in which the pressure regulating valve is designed to be open when deenergized. This embodiment has the advantage that the pressure regulating valve is opened to a maximum extent when it is not actuated or energized, which permits particularly safe and reliable operation in particular if a mechanical pressure relief valve is dispensed with. An inadmissible rise of the high pressure in the high-pressure accumulator can then be avoided even if an energization of the pressure regulating valve is not possible owing to a technical fault.

In a preferred exemplary embodiment, the pressure regulating valve is designed to be closed when unpressurized and deenergized. Here, said pressure regulating valve is designed so as to be closed when the pressure prevailing in the high-pressure accumulator, that is to say the rail pressure, is lower than an opening pressure value. The high pressure prevails at an inlet of the pressure regulating valve when said pressure regulating valve is installed correctly on the injection system. The pressure regulating valve opens when, in the deenergized state, the pressure prevailing at the inlet side reaches or overshoots the opening pressure value. Thus, if the pressure regulating valve is unpressurized at the inlet side and deenergized, said pressure regulating valve is preloaded into a closed state, for example by way of a mechanical preload element. If the input-side pressure reaches or overshoots the opening pressure value, and if the pressure regulating valve is not energized, said pressure regulating valve is opened, preferably counter to the force of the preload element, such that said pressure regulating valve is then open when deenergized in the presence of the opening pressure value and higher inlet pressures. If the pressure regulating valve is energized in said state, it closes in a manner dependent on the current with which it is actuated. Here, said pressure regulating valve is closed to the maximum extent when it is actuated with a predetermined maximum current value. If said pressure regulating valve is no longer energized, or if the energization fails, said pressure regulating valve fully opens again, wherein said pressure regulating valve closes if the inlet-side pressure falls below the opening pressure value.

The opening pressure value is preferably selected so as to be lower than a minimum high pressure reached in a normal regulating operating mode of the injection system. In particular, in the specific example mentioned above in conjunction with the two operation types of the protective operating mode, it is possible for the opening pressure value to be 850 bar. In this case, it is also preferable for the starting pressure value, at which, upon starting of the internal combustion engine, a transition from the standstill function of the pressure regulating valve to the normal function is performed, to be selected so as to lie approximately in the range of the opening pressure value, wherein said starting pressure value is preferably selected to be slightly lower in order to ensure that the pressure regulating valve is always actuated as soon as it opens as a result of the opening pressure value being reached or overshot. Here, allowance may also be made for tolerances of the pressure regulating valve. For example, it may be the case that the starting pressure value is selected to be 600 bar.

This yields the following functionality: if the internal combustion engine is at a standstill, and accordingly if the high pressure in the high-pressure accumulator has fallen below the opening pressure value, the pressure regulating valve is arranged in its standstill function, and is thus deenergized and unpressurized. Said pressure regulating valve is accordingly closed. Now, if the internal combustion engine starts, the closed pressure regulating valve firstly permits a rapid and reliable pressure build-up in the high-pressure accumulator, because no fuel is discharged via the pressure regulating valve into the fuel reservoir. Typically, it is now the case that the high pressure in the high-pressure accumulator firstly reaches the starting pressure value, whereby a transition from the standstill function to the normal function is performed, wherein the pressure regulating valve is consequently actuated. In this case, said pressure regulating valve however typically remains closed, because the opening pressure value has not yet been reached. The high pressure in the high-pressure accumulator rises further and finally also overshoots the opening pressure value, wherein the pressure regulating valve then opens and—in the absence of actuation—would also be open when deenergized. As a result of energization and corresponding actuation of the pressure regulating valve, it is now possible for the degree of opening of said pressure regulating valve to be influenced, and in particular for said pressure regulating valve to be closed further by way of increased energization or opened further by way of reduced energization. If, in the second operation type of the protective operating mode, a transition to the standstill function is performed again, the pressure regulating valve is no longer actuated, wherein, in this case, at the moment of the transition, a high pressure prevails which is higher than the second pressure threshold value, that is to say is in particular very much higher than the opening pressure value. Thus, in this state, the pressure regulation valve is deenergized and open, and thus, owing to the absence of actuation, discharges a maximum fuel volume flow from the high-pressure accumulator into the fuel reservoir, such that said pressure regulating valve safely and reliably performs its protective function. In this way, it is readily possible to dispense with a mechanical pressure relief valve. The pressure regulating valve closes again only when the high pressure falls below the opening pressure value. In this way, safe operation of the injection system is realized, and there is no longer a risk of damage or of an inadmissibly high pressure.

Finally, it is also the case that an injection system is preferred which is characterized in that it has no mechanical pressure relief valve. The injection system thus preferably does not have a mechanical pressure relief valve. Here, it is possible for the mechanical pressure relief valve to be omitted because its functionality can—as already discussed—be performed entirely by the pressure regulating valve.

The object is finally also achieved through the provision of an internal combustion engine. The internal combustion engine is characterized by an injection system according to one of the exemplary embodiments described above. Thus, the advantages that have already been discussed in conjunction with the method and with the injection system are realized in conjunction with the internal combustion engine.

The internal combustion engine is preferably in the form of a reciprocating-piston engine. In a preferred exemplary embodiment, the internal combustion engine serves for driving in particular heavy land vehicles or watercraft, for example mining vehicles or trains, wherein the internal combustion engine is used in a locomotive or motor coach, or ships. It is also possible for the internal combustion engine to be used for driving a vehicle which serves in the defense sector, for example a tank. An exemplary embodiment of the internal combustion engine is preferably also used in a static configuration, for example for static energy supply in emergency power operation, continuous load operation or peak load operation, wherein in this case, the internal combustion engine preferably drives a generator. It is also possible for the internal combustion engine to be used in a static configuration for the drive of auxiliary assemblies, for example fire-extinguishing pumps on drilling platforms. Furthermore, the internal combustion engine may be used in the field of the delivery of fossil resources and in particular fuels, for example oil and/or gas. It is also possible for the internal combustion engine to be used in the industrial sector or in the construction sector, for example in a construction or building machine, for example in a crane or in an excavator. The internal combustion engine is preferably in the form of a diesel engine, a gasoline engine or a gas engine for operation with natural gas, biogas, special gas or some other suitable gas. In particular if the internal combustion engine is in the form of a gas engine, it is suitable for use in a combined heat and power plant for static energy generation.

The description of the method, on the one hand, and of the injection system and of the internal combustion engine, on the other hand, are to be understood as being complementary to one another. In particular, features of the injection system or of the internal combustion engine which have been discussed explicitly or implicitly in conjunction with the method are preferably, individually or in combination with one another, features of a preferred exemplary embodiment of the injection system or of the internal combustion engine. Method steps that have been discussed explicitly or implicitly in conjunction with the injection system or the internal combustion engine are preferably, individually or in combination with one another, steps of a preferred embodiment of the method. The method is preferably characterized by at least one method step which is necessitated by at least one feature of the injection system or of the internal combustion engine. The injection system and/or the internal combustion engine are/is preferably characterized by at least one feature which is necessitated by at least one method step of a preferred embodiment of the method.

The invention will be discussed in more detail below on the basis of the drawing, in which:

BRIEF DESCRIPTION OF THE DRAWING

FIG. 6 is a fifth schematic detail illustration of an embodiment of the method.

DETAILED DESCRIPTION OF THE INVENTION

Figure 1:
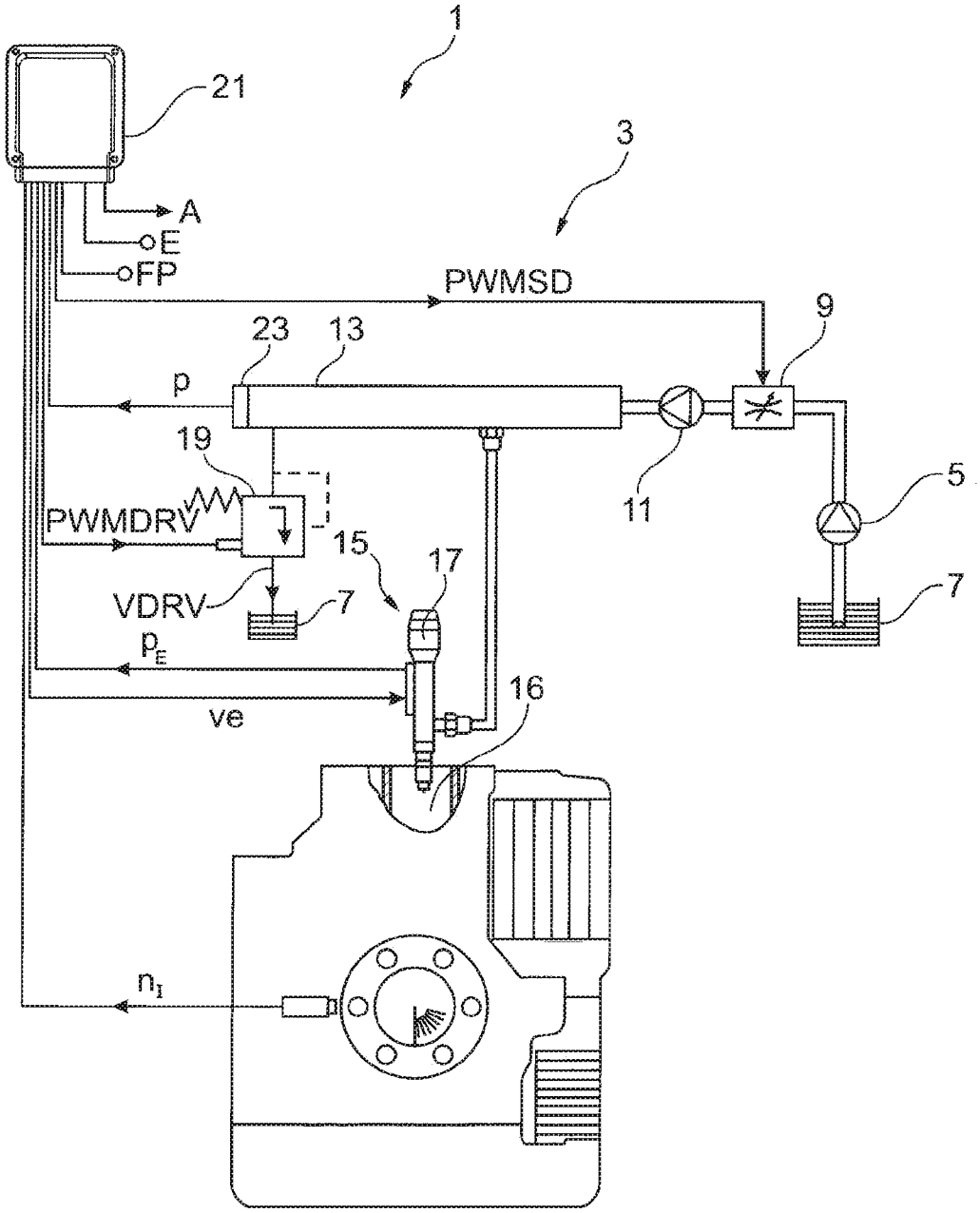
FIG. 1 is a schematic illustration of an exemplary embodiment of an internal combustion engine having an injection system.

FIG. 1 is a schematic illustration of an exemplary embodiment of an internal combustion engine 1 which has an injection system 3. The injection system 3 is preferably in the form of a common-rail injection system. Said injection system has a low-pressure pump 5 for the delivery of fuel from a fuel reservoir 7, an adjustable, low-pressure-side suction throttle 9 for influencing a fuel volume flow flowing through said low-pressure pump, a high-pressure pump 11 for delivering the fuel at elevated pressure into a high-pressure accumulator 13, the high-pressure accumulator 13 for storing the fuel, and a multiplicity of injectors 15 for injecting the fuel into combustion chambers 16 of the internal combustion engine 1. It is optionally possible for the injection system 3 to also be formed with individual accumulators, wherein then, it is for example the case that an individual accumulator 17 as an additional buffer volume is integrated in the injector 15. An in particular electrically actuable pressure regulating valve 19 is provided, by way of which the high-pressure accumulator 13 is fluidically connected to the fuel reservoir 7. By way of the position of the pressure regulating valve 19, a fuel volume flow which is discharged from the high-pressure accumulator 13 into the fuel reservoir 7 is defined. Said fuel volume flow is denoted in FIG. 1 and in the following text by VDRV, and represents a high-pressure disturbance variable of the injection system 3.

The injection system 3 has no mechanical pressure relief valve, such as is commonly provided in the prior art so as to connect the high-pressure accumulator 13 to the fuel reservoir 7. According to the invention, the mechanical pressure relief valve can be dispensed with because its function is performed entirely by the pressure regulating valve 19.

The operation of the internal combustion engine 1 is defined by an electronic control unit 21 which is preferably in the form of an engine control unit (ECU) of the internal combustion engine 1. The electronic control unit 21 comprises the conventional constituent parts of a microcomputer system, for example a microprocessor, I/O components, buffers and memory components (EEPROM, RAM). The operating data relevant for the operation of the internal combustion engine 1 are stored in the memory components in the form of characteristic maps/characteristic curves. Using these, the electronic control unit 21 calculates output variables from the input variables. In FIG. 1, the following input variables are illustrated by way of example: a measured, still-unfiltered high pressure p, which prevails in the high-pressure accumulator 13 and which is measured by way of a high-pressure sensor 23, a present engine speed $n_I$, a signal FP relating to the power demanded by an operator of the internal combustion engine 1, and an input variable E. The input variable E preferably encompasses further sensor signals, for example a charge-air pressure of an exhaust-gas turbocharger. In the case of an injection system 3 with individual accumulators 17, an individual-accumulator pressure $p_E$ is preferably an additional input variable of the control unit 21.

As output variables of the electronic control unit 21, FIG. 1 illustrates, by way of example, a signal PWMSD for the actuation of the suction throttle 9 as first pressure setting element, a signal ve for the actuation of the injectors 15, said signal predefining in particular a start of injection and/or an end of injection or else an injection duration, a signal PWMDRV for the actuation of the pressure regulating valve 19 as a second pressure setting element, and an output variable TA. By way of the preferably pulse-width-modulated signal PWMDRV, the position of the pressure regulating valve 19 and thus the high-pressure disturbance variable VDRV are defined. The output variable A represents further control signals for the control and/or regulation of the internal combustion engine 1, for example a control signal for the activation of a second exhaust-gas turbocharger in the case of a sequential supercharging arrangement.

Figure 2:
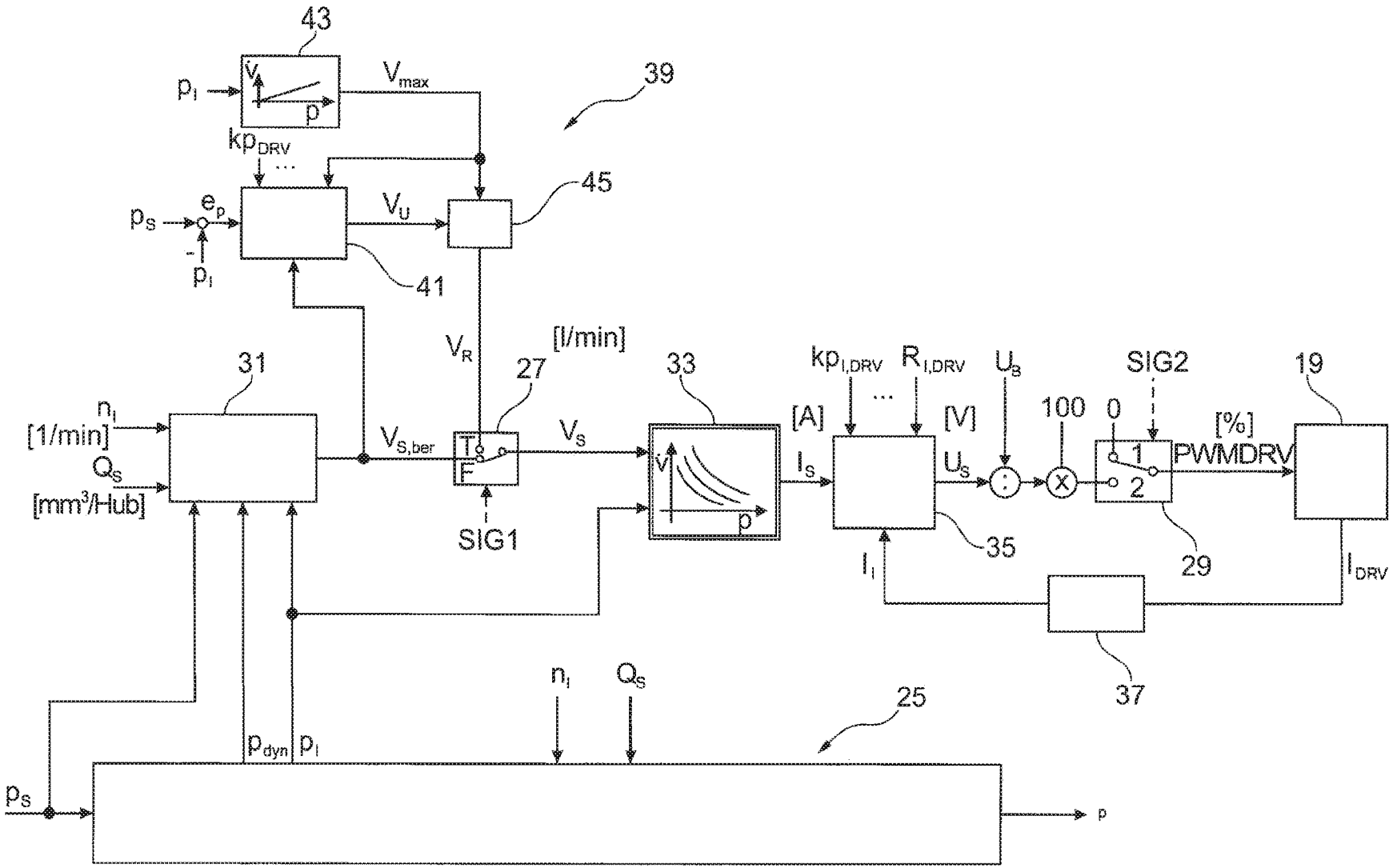
FIG. 2 is a first schematic detail illustration of an embodiment of the method.

FIG. 2 is a first schematic illustration of an embodiment of the method. A first high-pressure regulating loop 25 is provided, by way of which, in a normal operating mode of the injection system 3, the high pressure in the high-pressure accumulator 13 is regulated by means of the suction throttle 9 as first pressure setting element. The first high-pressure regulating loop 25 will be discussed in more detail in conjunction with FIG. 7, where it is presented in detail. The first high-pressure regulating loop 25 has, as an input variable, a setpoint high pressure $p_S$ for the injection system 3. Said setpoint high pressure is preferably read out from a characteristic map in a manner dependent on an engine speed of the internal combustion engine 1, a load or torque demand on the internal combustion engine 1, and/or in a manner dependent on further variables, which serve in particular for correction purposes. Further input variables of the first high-pressure regulating loop 25 are in particular a measured engine speed in of the internal combustion engine 1 and a setpoint injection quantity $Q_S$, which is in particular likewise read out from a characteristic map. As an output variable, the first high-pressure regulating loop 25 has, in particular, the high pressure p measured by the high-pressure sensor 23, said high pressure preferably being subjected to a first filtering with a relatively long time constant in order to determine the actual high pressure $p_I$, wherein said high pressure is preferably simultaneously subjected to a second filtering with a relatively short time constant in order to calculate a dynamic rail pressure $p_{dyn}$. Said two pressure values $p_I$, $p_{dyn}$ constitute further output variables of the first high-pressure regulating loop 25.

FIG. 2 illustrates the actuation of the pressure regulating valve 19. It is preferably the case that a first switching element 27 is provided by way of which a switchover between the normal operating mode and a first operation type of a protective operating mode can be performed in a manner dependent on a first logic signal SIG1. The switching element 27 is preferably realized entirely on an electronic or software level. Here, the functionality described below is preferably switched over in a manner dependent on the value of a variable corresponding to the first logic signal SIG1, which variable is in particular in the form of a so-called flag and can assume the values "true" or "false". It is however self-evidently alternatively also possible for the switching element 27 to be in the form of a physical switch, for example a relay. Said switch can then be switched for example in a manner dependent on a level of an electrical signal. In the case of the specific embodiment illustrated here, the normal operating mode is set if the first logic signal SIG1 has the value "false". By contrast, the first operation type of the protective operating mode is set if the first logic signal SIG1 has the value "true".

A second switching element 29 is provided which is set up for switching the actuation of the pressure regulating valve 19 from the normal function to the standstill function and back. Here, the second switching element 29 is controlled in a manner dependent on a second logic signal SIG2 or in a manner dependent on the value of a corresponding variable. The second switching element 29 may be in the form of a virtual, in particular software-based switching element which switches between the normal function and the standstill function in a manner dependent on the value of a variable which is in particular in the form of a flag. It is however alternatively also possible for the second switching element to be in the form of a physical switch, for example a relay, which switches in a manner dependent on a signal value of an electrical signal. In the specific embodiment illustrated here, the second logic signal SIG2 corresponds to a state variable which can assume the values 1 for a first state and 2 for a second state. Here, the normal function for the pressure regulating valve is set if the second logic signal SIG2 assumes the value 2, wherein the standstill function is set if the second logic signal SIG2 assumes the value 1. It is self-evidently possible for the second logic signal SIG2 to be defined differently, in particular such that a corresponding variable can assume the values 0 and 1.

Firstly, a description will be given of the actuation of the pressure regulating valve 19 in the normal operating mode and in the case of the normal function having been set. A calculation element 31 is provided which outputs a calculated setpoint volume flow $V_{S,ber}$ as an output variable, wherein the present engine speed $n_I$, the setpoint injection quantity $Q_S$, the setpoint high pressure $p_S$, the dynamic rail pressure $p_{dyn}$ and the actual high pressure $p_I$ are input as input variables into the calculation element 31. The functioning of the calculation element 31 is described in detail in the German patents DE 10 2009 031 528 B3 and DE 10 2009 031 527 B3. Here, it is shown in particular that, in a low-load range, for example during idle operation of the internal combustion engine 1, a positive value is calculated for a steady-state setpoint volume flow, whereas a steady-state setpoint volume flow of 0 is calculated in a normal operating range. The steady-state setpoint volume flow is preferably corrected by adding a dynamic setpoint volume flow, which in turn is calculated by way of a dynamic correction in a manner dependent on the setpoint high pressure $p_S$, the actual high pressure $p_I$ and the dynamic rail pressure $p_{dyn}$. The calculated setpoint volume flow $V_{S,ber}$ is finally the sum of the steady-state setpoint volume flow and the dynamic setpoint volume flow. The calculated setpoint volume flow $V_{S,ber}$ is thus a resultant setpoint volume flow.

In the normal operating mode, when the first logic signal SIG1 has the value "false", the calculated setpoint volume flow $V_{S,ber}$ is transmitted as setpoint volume flow $V_S$ to a pressure regulating valve characteristic map 33. Here, as described in the German patent DE 10 2009 031 528 B3, the pressure regulating valve characteristic map 33 replicates an inverse characteristic of the pressure regulating valve 19. An output variable of said characteristic map is a pressure regulating valve setpoint current $I_S$; input variables are the setpoint volume flow $V_S$ to be discharged and also the actual high pressure $p_I$.

In an alternative embodiment of the method, it is also possible for the setpoint volume flow $V_S$ not to be calculated by way of the calculation element 31 but to be predefined as a constant in the normal operating mode.

The pressure regulating valve setpoint current $I_S$ is fed to a current regulator 35 which has the task of regulating the current for the actuation of the pressure regulating valve 19. Further input variables of the current regulator 35 are for example a proportional coefficient $kp_{I,DRV}$ and an ohmic resistance $R_{I,DRV}$ of the pressure regulating valve 19. An output variable of the current regulator 35 is a setpoint voltage $U_S$ for the pressure regulating valve 19, which setpoint voltage is, in relation to an operating voltage $U_B$, converted in conventional fashion into an activation duration for the pulse-width-modulated signal PWMDRV for the actuation of the pressure regulating valve 19, and is fed to said pressure regulating valve in the normal function, that is to say when the second logic signal SIG2 has the value 2. For the current regulation, the current at the pressure regulating valve 19 is measured as current variable $I_{DRV}$, filtered in a current filter 37 and supplied as a filtered actual current Ii to the current regulator 35 again.

As already indicated, the activation duration PWMDRV of the pulse-width-modulated signal is, for the actuation of the pressure regulating valve 19, calculated in a conventional manner from the setpoint voltage $U_S$ and the operating voltage $U_B$ in accordance with the following equation:

$$PWMDRV=(U_S/U_B)\times 100. \quad (1)$$

In this way, in the normal operating mode, a high-pressure disturbance variable, specifically the discharged setpoint volume flow $V_S$, is generated by way of the pressure regulating valve 19 as second pressure setting element.

If the first logic signal SIG1 assumes the value "true", the switching element 27 switches over from the normal operating mode to the first operation type of the protective operating mode. The conditions under which this is performed will be discussed in conjunction with FIG. 3. With regard to the actuation of the pressure regulating valve 19, there is no difference in the first operation type of the protective operating mode, because it is also the case here that the pressure regulating valve 19 is actuated with the setpoint volume flow $V_S$, in any case for as long as the normal function is set by way of the switching element 29. In this respect, in FIG. 2, to the right of the switching element 27, there is no change in relation to the explanations given above. However, the setpoint volume flow $V_S$ is calculated differently in the first operation type of the protective operating mode than in the normal operating mode, specifically by way of a second high-pressure regulating loop 39.

In this case, the setpoint volume flow $V_S$ is set to be identical to a limited output volume flow $V_R$ of a pressure regulating valve pressure regulator 41. This corresponds to the upper switch position of the switch element 27. The pressure regulating valve pressure regulator 41 has, as an input variable, a high-pressure regulating deviation $e_p$ which is calculated as the difference between the setpoint high pressure $p_S$ and the actual high pressure $p_I$. Further input variables of the pressure regulating valve pressure regulator 41 are preferably a maximum volume flow $V_{max}$ for the pressure regulating valve 19, the setpoint volume flow $V_{S,ber}$ calculated in the calculation element 31, and/or a proportional coefficient $kp_{DRV}$. The pressure regulating valve pressure regulator 41 is preferably implemented as a $PI(DT_1)$ algorithm which will be discussed in more detail in FIG. 6. Here, as will be discussed further, an integrating component (I component) is, at the time at which the switching element 27 is switched over from its lower switch position illustrated in FIG. 2 into its upper switch position, initialized with the calculated setpoint volume flow $V_{S,ber}$. The I component of the pressure regulating valve pressure regulator 41 is upwardly limited to the maximum volume flow $V_{max}$ for the pressure regulating valve 19. Here, the maximum volume flow $V_{max}$ is preferably an output variable of a two-dimensional characteristic curve 43 which has the maximum volume flow passing through the pressure regulating valve 19 as a function of the high pressure, wherein the characteristic curve 43 receives the actual high pressure $p_I$ as input variable. An output variable of the pressure regulating valve pressure regulator 41 is an unlimited volume flow $V_U$ which is limited to the maximum volume flow $V_{max}$ in a limitation element 45. The limitation element 45 finally outputs, as output variable, the limited setpoint volume flow $V_R$. Using this as setpoint volume flow $V_S$, the pressure regulating valve 19 is then actuated by virtue of the setpoint volume flow $V_S$ being supplied, in the manner already described, to the pressure regulating valve characteristic map 33.

Figure 3:
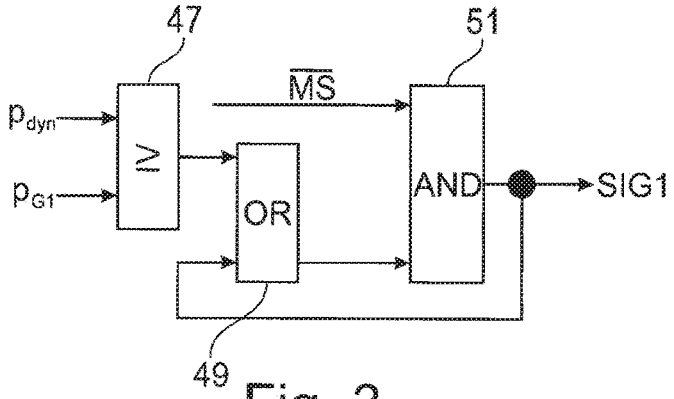
FIG. 3 is a second schematic detail illustration of an embodiment of the method.

FIG. 3 shows the conditions under which the first logic signal SIG1 assumes the values "true" and "false". For as long as the dynamic rail pressure $p_{dyn}$ does not reach or overshoot a first pressure threshold value $p_{G1}$, the output of a first comparator element 47 has the value "false". Upon starting of the internal combustion engine 1, the value of the first logic signal SIG1 is initialized with "false". In this way, the output of a first OR element 49 is also "false" for as long as the output of the first comparator element 47 has the value "false". The output of the first OR element 49 is supplied to an input of a first AND element 51, to the other input of which the negative, indicated by a horizontal dash, of a variable MS is supplied, wherein the variable MS has the value "true" if the internal combustion engine 1 is at a standstill and has the value "false" when the internal combustion engine 1 is running. Accordingly, during the operation of the internal combustion engine, the value of the negative of the variable MS is "true". Altogether, it is now the case that the output of the AND element 51 and thus the value of the first logic signal SIG1 is "false" for as long as the dynamic rail pressure $p_{dyn}$ does not reach or overshoot the first pressure threshold value $p_{G1}$.

If the dynamic rail pressure $p_{dyn}$ reaches or overshoots the first pressure threshold value $p_{G1}$, the output of the first comparator element 47 changes from "false" to "true". Thus, the output of the first OR element 49 also changes from "false" to "true". When the internal combustion engine 1 is running, the output of the first AND element 51 also changes from "false" to "true", such that the value of the first logic signal SIG1 becomes "true". Said value is supplied to the first OR element 49 again, which however does not change the fact that the output thereof remains "true". Even a drop of the dynamic rail pressure $p_{dyn}$ to below the first pressure threshold value $p_{G1}$ can no longer change the logic value of the first logic signal SIG1. Said value rather remains "true" until the variable MS and thus also the negative thereof changes its logic value, specifically when the internal combustion engine 1 is no longer running.

The following is thus the case: the normal operating mode is realized for as long as the dynamic rail pressure $p_{dyn}$ lies below the threshold value $p_{G1}$. In this case, the setpoint volume flow $V_S$ is *identical to the calculated setpoint volume flow* $V_{S,ber}$, because the first logic signal SIG1 assumes the value "false", and thus the switching element 27 is arranged in its lower position in FIG. 2. If the dynamic rail pressure $p_{dyn}$ reaches or overshoots the threshold value $p_{G1}$, the first logic signal SIG1 assumes the value "true", and the switching element 27 assumes its upper switch position. Therefore, in this case, the setpoint volume flow $V_S$ is identical to the limited volume flow $V_R$ of the second high-pressure regulating loop 39. This means that, in the normal operating mode, a high-pressure disturbance variable is generated by way of the pressure regulating valve 19, wherein, in the first operation type of the protective operating mode, whenever the dynamic rail pressure $p_{dyn}$ reaches the first pressure threshold value $p_{G1}$, the high pressure is subsequently regulated by the pressure regulating valve pressure regulator 41 until it is identified that the internal combustion engine 1 is at a standstill, because it is only in this case that the variable MS assumes the value "true", the negative thereof thus assumes the value "false" and thus, ultimately, the first logic signal SIG1 assumes the value "false" again, whereby the switching element 27 is moved into its lower switch position again.

It is after all the case that, in the first operation type of the protective operating mode, the pressure regulating valve 19 performs the regulation of the high pressure by way of the second high-pressure regulating loop 39.

Returning to FIG. 2, the second operation type of the protective operating mode will be discussed below: a switch is made to the second operation type if, here, the second logic signal SIG2 assumes the value 1. In this case, the second switching element 29 is arranged in its upper switching position illustrated in FIG. 2, wherein, in this way, a standstill function for the pressure regulating valve 19 is set. In said standstill function, the pressure regulating valve 19 is not actuated, that is to say the signal PWMDRV is set to 0. Since a pressure regulating valve 19 which is open when deenergized is preferably used, said pressure regulating valve now constantly discharges a maximum fuel volume flow from the high-pressure accumulator 13 into the fuel reservoir 7.

By contrast, if the second logic signal SIG2 has the value 2, it is the case, as already discussed, that the normal function for the pressure regulating valve 19 is set, and said pressure regulating valve is actuated by means of the setpoint volume flow $V_S$ and the signal PWMDRV calculated therefrom.

Figure 4:
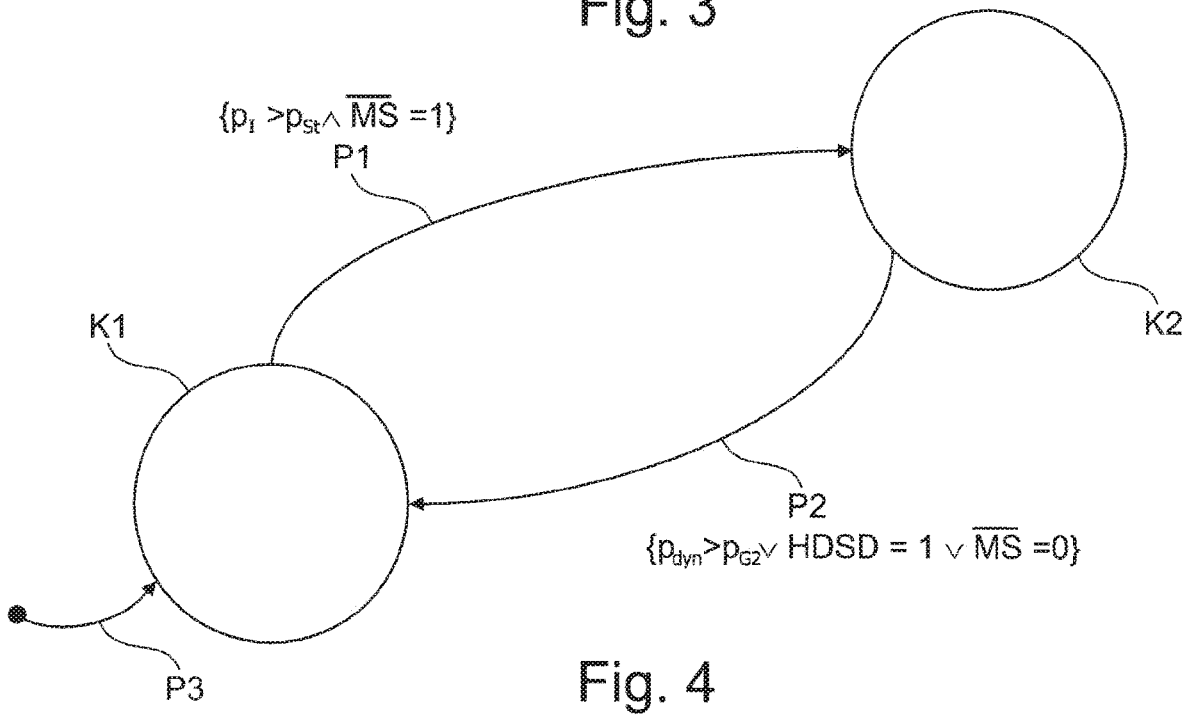
FIG. 4 is a third schematic detail illustration of an embodiment of the method.

FIG. 4 schematically shows a state change diagram for the pressure regulating valve 19 from the normal function into the standstill function and vice versa. Here, the pressure regulating valve 19 is preferably designed so as to be closed when unpressurized and deenergized, wherein said pressure regulating valve is furthermore designed so as to be closed when a pressure up to an opening pressure value prevails on the inlet side, wherein said pressure regulating valve opens if the pressure prevailing on the inlet side reaches or overshoots the opening pressure value in the deenergized state. The opening pressure value may for example be 850 bar.

In FIG. 4, a first circle K1 symbolizes the standstill function, wherein, at the top right, a second circle K2 symbolizes the normal function. A first arrow P1 represents a transition between the standstill function and the normal function, wherein a second arrow P2 illustrates a transition between the normal function and the standstill function. A third arrow P3 indicates an initialization of the internal combustion engine 1 after starting, wherein the pressure regulating valve 19 is firstly initialized in the standstill function. Only when it is identified that the internal combustion engine 1 is running and, at the same time, the actual high pressure $p_I$ overshoots a starting value $p_{St}$ is the normal function set for the pressure regulating valve 19—along the arrow P1—and the standstill function reset. The normal function is reset, and the standstill function set along the arrow P2, if the dynamic rail pressure $p_{dyn}$ overshoots a second pressure threshold value $p_{G2}$, or if a defect of a high-pressure sensor—illustrated in this case by a logic variable HDSD—is identified or if it is identified that the internal combustion engine 1 is at a standstill. In the standstill function, the pressure regulating valve 19 is not actuated, wherein, in the normal function—as discussed in conjunction with FIG. 2—said pressure regulating valve is actuated by means of the setpoint volume flow $V_S$.

The following functionality is now realized: upon starting of the internal combustion engine 1, it is initially the case that high pressure does not prevail in the high-pressure accumulator 13, and the pressure regulating valve 19 is arranged in its standstill function, such that it is unpressurized and deenergized, that is to say closed. During the running-up of the internal combustion engine 1, it is thus possible for a high pressure to be rapidly built up in the high-pressure accumulator, which high pressure at some point exceeds the starting value $p_{St}$. Said starting value is preferably lower than the opening pressure value of the pressure regulating valve 19, such that, for said pressure regulating valve, the normal function is firstly set before said pressure regulating valve opens. In this way, it is advantageously ensured that the pressure regulating valve 19 is actuated every time it first opens. Since said pressure regulating valve is closed when unpressurized, it remains closed even when actuated until the actual high pressure $p_I$ also overshoots the opening pressure value, wherein said pressure regulating valve then opens and is actuated in the normal function, specifically either in the normal operating mode or in the first operation type of the protective operating mode.

However, if one of the above-described situations arises, it is in turn the case that the standstill function for the pressure regulating valve 19 is set.

This is the case in particular if the dynamic rail pressure $p_{dyn}$ overshoots the second pressure threshold value $p_{G2}$, wherein said second pressure threshold value is preferably selected to be higher than the first pressure threshold value $p_{G1}$, and has in particular a value at which, in the case of a conventional embodiment of the injection system, a mechanical pressure relief valve would open. Since the pressure regulating valve 19 is open under the action of pressure and when deenergized, said pressure regulating valve in this case opens fully in the standstill function and thus safely and reliably ensures the function of a pressure relief valve.

The transition from the normal function to the standstill function also takes place if a defect in the high-pressure sensor 23 is detected. If a defect is present here, it is no longer possible for the high pressure in the high-pressure accumulator 13 to be regulated. In order that the internal combustion engine 1 can nevertheless still be operated safely, the transition from the normal function to the standstill function is effected for the pressure regulating valve 19, such that said pressure regulating valve opens and thus prevents an inadmissible rise of the high pressure.

Furthermore, the transition from the normal function into the standstill function is performed in a situation in which it is detected that the internal combustion engine 1 is at a standstill. This corresponds to a resetting of the pressure regulating valve 19, such that, upon a restart of the internal combustion engine 1, the cycle described here can begin again from the start.

If, for the pressure regulating valve 19, under the action of pressure in the high-pressure accumulator 13, the standstill function is set, said pressure regulating valve is opened to the maximum extent and discharges a maximum volume flow from the high-pressure accumulator 13 into the fuel reservoir 7. This corresponds to a protective function for the internal combustion engine and the injection system 3, wherein said protective function can in particular replace the absence of a mechanical pressure relief valve.

It is essential here that the pressure regulating valve 19 has—by contrast to the prior art—only two states, specifically the standstill function and the normal function, wherein said two states are entirely sufficient to replicate the entire relevant functionality of the pressure regulating valve 19 including the protective function for replacing a mechanical pressure relief valve.

Figure 5:
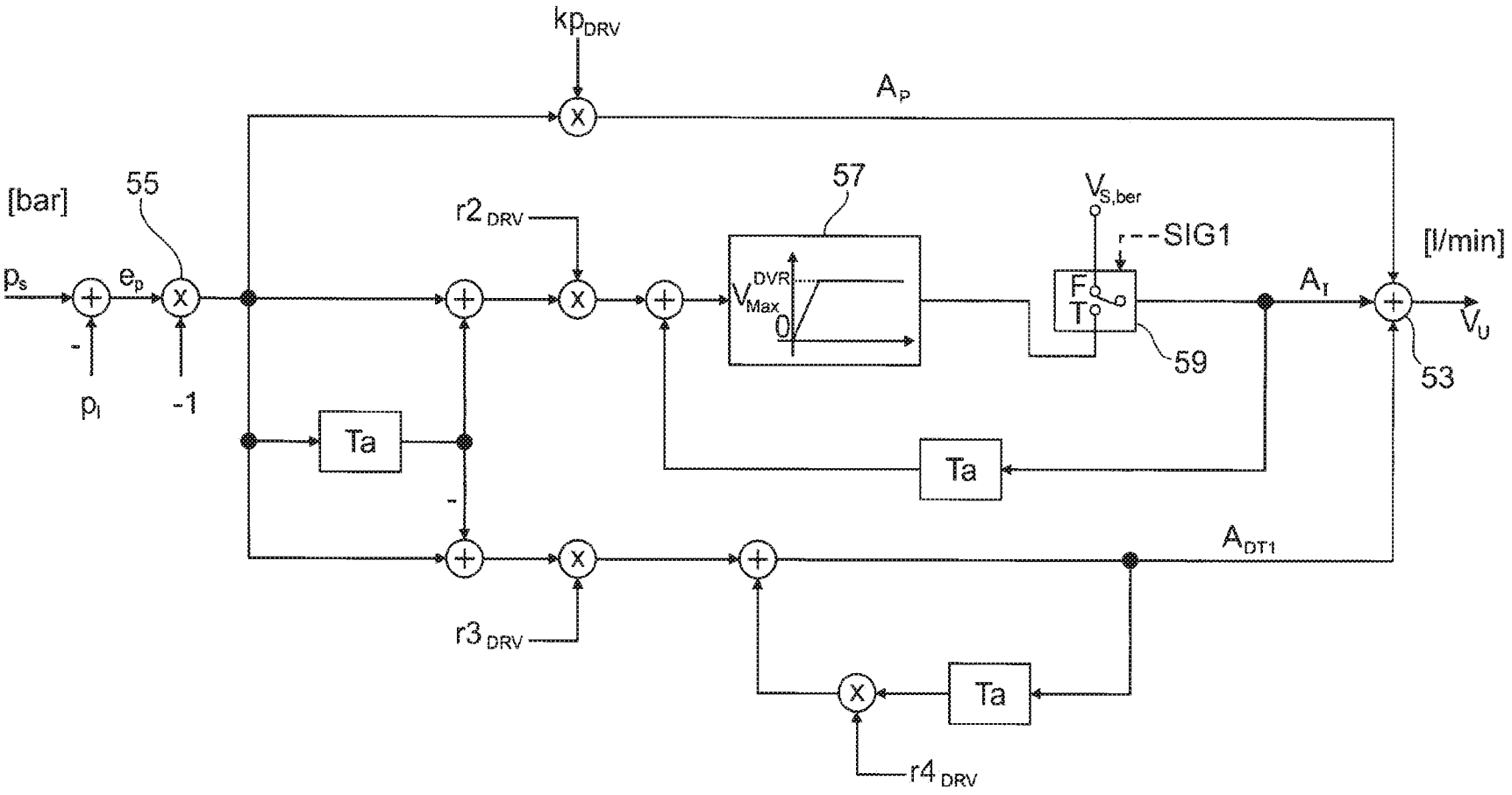
FIG. 5 is a fourth schematic detail illustration of an embodiment of the method.

FIG. 5 is a schematic illustration of the pressure regulating valve pressure regulator 41, which in this case is in the form of a PI($DT_1$) pressure regulator. Here, it can be seen that the output variable $V_U$ of the pressure regulating valve pressure regulator 41 is composed of three added-together regulator components, specifically a proportional component $A_P$, an integral component $A_I$ and a differential component $A_{DTI}$. Said three components are added together at a summing junction 53 to form the unlimited volume flow $V_U$. Here, the proportional component $A_P$ represents the product of the regulating deviation $e_p$, multiplied at a multiplication junction 55 by the value −1, with the proportional coefficient $kp_{DRV}$. The integrating component $A_I$ results from the sum of two summands. The first summand is in this case the present integral component $A_I$ delayed by a sampling step $T_a$. The second summand is the product of a gain factor $r2_{DRV}$ and the sum of the present regulating deviation $e_p$ and of said regulating deviation delayed by one sampling step—again multiplied at the multiplication junction 55 by the factor −1. The sum of the two summands is in this case limited upwardly to the maximum volume flow $V_{max}$ in a limitation element 57. The gain factor $r2_{DRV}$ is calculated in accordance with the following formula, in which $tnD_{RV}$ is a reset time:

$$r2_{DRV} = \frac{64kp_{DRV}T_a}{tn_{DRV}}. \tag{2}$$

The integrating component $A_I$ is dependent on whether the dynamic rail pressure $p_{dyn}$ has reached the first pressure threshold value $p_{G1}$ for the first time after the starting of the internal combustion engine 1. If this is the case, the first logic signal SIG1 assumes the value "true", and a switching element 59 illustrated in FIG. 5 switches into its lower switch position. In said switch position, the integrating component $A_I$ is identical to the output signal of the limitation element 57, that is to say the integrating component $A_I$ is limited to the maximum volume flow $V_{max}$. If it is identified that the internal combustion engine 1 is at a standstill, it is the case—as already discussed in conjunction with FIG. 3—that the first logic signal SIG1 assumes the value "false", and the switching element 59 switches into its upper switch position. The integrating component $A_I$ is in this case set to the calculated volume flow $V_{S,ber}$. Thus, the calculated setpoint volume flow $V_{S,ber}$ constitutes the initialization value of the integrating component $A_I$ for the situation in which the pressure regulating valve pressure regulator 41 is activated when the dynamic rail pressure $p_{dyn}$ overshoots the first pressure threshold value psi.

The calculation of the differential component $A_{DTI}$ is illustrated in the lower part of FIG. 5. Said component is formed as the sum of two products. The first product results from a multiplication of the factor $r4_{DRV}$ with the differential fraction $A_{DTI}$ delayed by one sampling step. The second product is formed from the multiplication of the factor $r3_{DRV}$ with the difference between the regulating deviation $e_p$ multiplied by the factor −1 and the corresponding regulating deviation $e_p$ delayed by one sampling step and multiplied by the factor −1.

Here, the factor $r3_{DRV}$ is calculated in accordance with the following equation, in which $tv_{DRV}$ is a lead time and $t1_{DRV}$ is a lag time:

$$r3_{DRV} = \frac{2kp_{DRV}tv_{DRV}}{2t1_{DRV} + T_a}. \tag{3}$$

The factor $r4_{DRV}$ is calculated in accordance with the following equation:

$$r4_{DRV} = \frac{2t1_{DRV} - T_a}{2t1_{DRV} + T_a}. \tag{4}$$

It is thus evident that the gain factors $r2_{DRV}$ and $r3_{DRV}$ are dependent on the proportional coefficient $kp_{DRV}$. The gain factor $r2_{DRV}$ is additionally dependent on the reset time $tn_{DRV}$, the gain factor $r3_{DRV}$ is additionally dependent on the lead time $tv_{DRV}$ and on the lag time $t1_{DRV}$. The gain factor $r4_{DRV}$ is likewise dependent on the lag time $t1_{DRV}$.

FIG. 6 is a schematic illustration of a logic arrangement for the calculation of the value of a third logic signal SIG3 which is used to ensure that, here, in the first and in the second operation types of the protective operating mode, the suction throttle 9 is actuated for permanently open operation. This approach will be discussed in more detail in conjunction with FIG. 7. The value of the third logic signal SIG3 results from a second AND element 61, into the first output of which it is again the case that the negative of the variable MS is input, wherein the result of a prior calculation that will be discussed in more detail below is input into the second input. The third logic signal SIG3 is, upon the starting of the internal combustion engine 1, firstly initialized with the value "false". Into the first input of a second OR element 63 there is input the result of a second comparator element 65, in which it is checked whether the dynamic rail pressure $p_{dyn}$ is greater than or equal to the first pressure threshold value $p_{G1}$. Into the second input of the second OR element 63 there is input the result of a comparison element 67 which checks whether the value of the logic variable HDSD, which indicates a sensor defect of the high-pressure sensor 23, is equal to 1, wherein, in this case, a sensor defect is present, and wherein no sensor defect is present if the value of the variable HDSD is equal to 0. It is thus evident that the output of the second OR element 63 assumes the value "true" if at least one of the outputs of the second comparator element 65 or of the comparison element 67 assumes the value "true". Thus, in order for the output of the second OR element 63 to assume the value "true", at least one of the following conditions must be met: the dynamic rail pressure $p_{dyn}$ must have reached or overshot the first pressure threshold value $p_{G1}$, and/or a sensor defect in the high-pressure sensor 23 must have been detected, such that the variable HDSD assumes the value 1. If neither of said conditions is met, the output of the second OR element 63 has the value "false".

The output of the second OR element 63 is input into a first input of a third OR element 69, into the second input of which the value of the third logic signal SIG3 is input. Since said third logic signal is originally initialized with the value "false", the output of the third OR element 69 has the value "false" until the output of the second OR element 63 assumes the value "true". If this is the case, the output of the third OR element 69 also changes to the value "true". In this case, the value of the second AND element 61 also changes to "true" if the internal combustion engine 1 is running, such that the value of the third logic signal SIG3 also changes to "true". It is evident from FIG. 6 that the value of the third logic signal SIG3 remains "true" until it is identified that the internal combustion engine 1 is at a standstill, wherein, in this case, the variable MS assumes the value "true", and thus the negative thereof assumes the value "false".

If, alternatively, it is sought for the suction throttle 9 to be permanently open only in the second operation type of the protective operating mode, this can be achieved by virtue of the second pressure threshold value $p_{G2}$ instead of the first pressure threshold value $p_{G1}$ being used in the second comparator element 65 and being compared with the dynamic rail pressure $p_{dyn}$.

Figure 7:
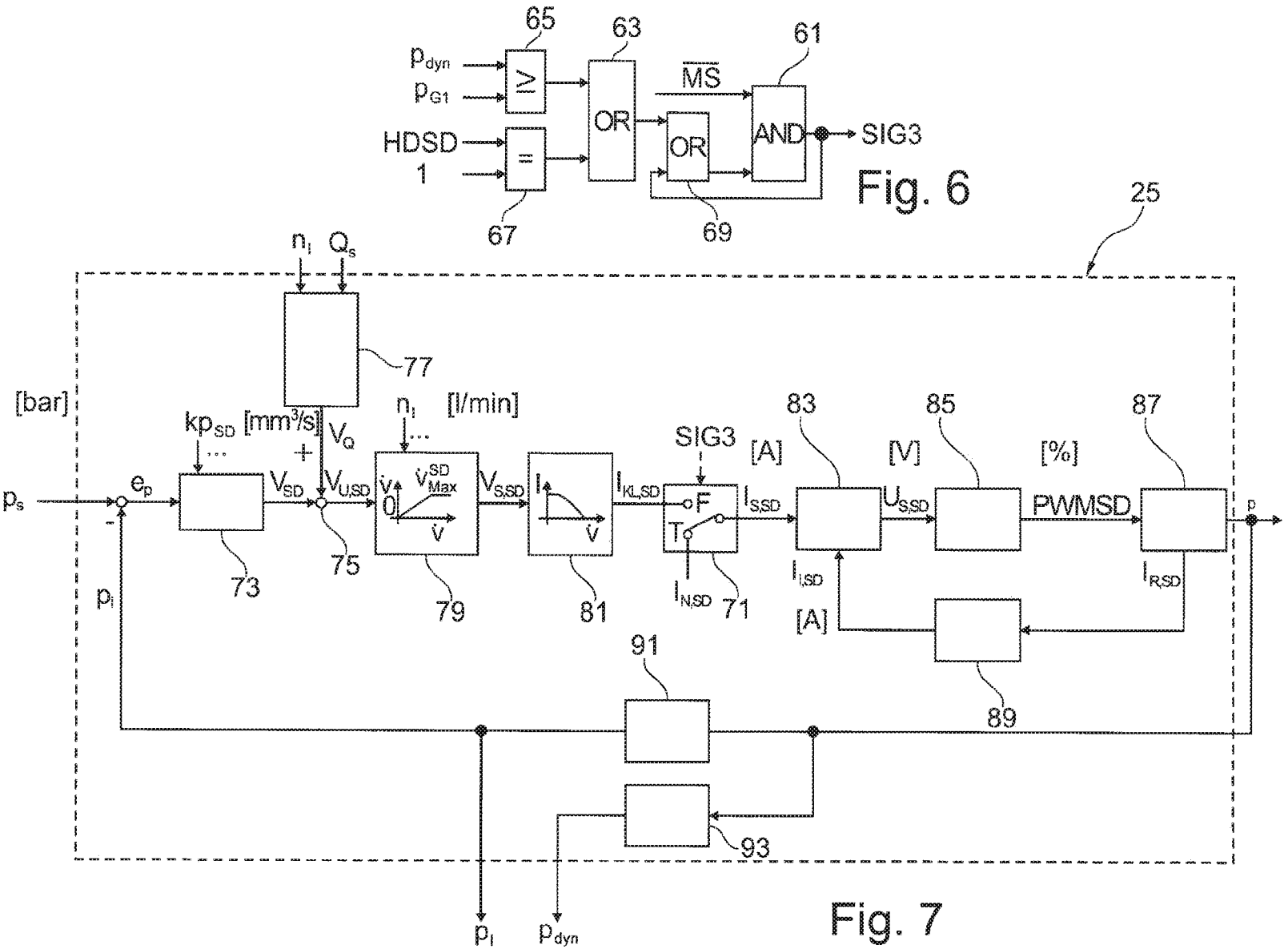
FIG. 7 is a sixth schematic detail illustration of an embodiment of the method.

FIG. 7 is a schematic illustration of the first high-pressure regulating loop 25 including a switching element 71 for realizing the permanently open operation of the suction throttle 9 in the first and second operation types of the protective operating mode, wherein the third logic signal SIG3, the calculation of which has been described in conjunction with FIG. 6, is input into the switching element 71 for the actuation thereof. It is possible for the switching element 71 to be in the form of a software switch, that is to say in the form of a purely virtual switch, as has already been described in conjunction with the switching elements 27, 29. Alternatively, it is self-evidently also possible for the switching element 71 to be in the form of a physical switch, for example a relay.

As has already been discussed, an input variable of the high-pressure regulating loop 25 is the setpoint high pressure $p_S$ which, for the calculation of the regulating deviation $e_p$, is compared with the actual high pressure $p_I$. Said regulating deviation $e_p$ is an input variable of a high-pressure regulator 73, which is preferably implemented as a $PI(DT_1)$ algorithm. A further input variable of the high-pressure regulator 73 is preferably a proportional coefficient $kp_{SD}$. An output variable of the high-pressure regulator 73 is a fuel volume flow $V_{SD}$ for the suction throttle 9, to which, at a summing junction 75, a fuel setpoint consumption $V_Q$ is added. Said fuel setpoint consumption $V_Q$ is calculated in a calculation element 77 in a manner dependent on the engine speed $n_I$ and the setpoint injection quantity $Q_S$, and constitutes a disturbance variable of the first high-pressure regulating loop 25. A sum of the output variable $V_{SD}$ of the high-pressure regulator 73 and of the disturbance variable $V_Q$ yields an unlimited fuel setpoint volume flow $V_{U,SD}$. This is, in a limitation element 79, limited in a manner dependent on the engine speed $n_I$ to a maximum volume flow $V_{max,SD}$ for the suction throttle 9. An output of the limitation element 79 is a limited fuel setpoint volume flow $V_{S,SD}$ for the suction throttle 9, this being input as an input variable into a pump characteristic curve 81. The latter converts the limited fuel setpoint volume flow $V_{S,SD}$ into a characteristic curve suction throttle current $I_{KL,SD}$.

If the switch element 71 is in the upper switching state illustrated in FIG. 7, which is the case if the third logic signal SIG3 has the value "false", a suction throttle setpoint current $I_{S,SD}$ is set equal to the characteristic curve suction throttle current $I_{KL,SD}$. Said suction throttle setpoint current $I_{S,SD}$ constitutes the input variable of a suction throttle current regulator 83 which has the task of regulating the suction throttle current through the suction throttle 9. A further input variable of the suction throttle current regulator 83 is, inter alia, an actual suction throttle current $I_{I,SD}$. An output variable of the suction throttle current regulator 83 is a suction throttle setpoint voltage $U_{S,SD}$ which is finally, in a calculation element 85, converted in a manner known per se into an activation duration of a pulse-width-modulated signal PWMSD for the suction throttle 9. The suction throttle is actuated using said signal, wherein the signal thus acts overall on a regulating path 87 which has in particular the suction throttle 9, the high-pressure pump 11 and the high-pressure accumulator 13. The suction throttle current is measured, wherein the result is an unprocessed measurement value $I_{R,SD}$ which is filtered in a current filter 89. The current filter 89 is preferably in the form of a $PT_1$ filter. An output variable of said filter is the actual suction throttle current $I_{I,SD}$, which in turn is supplied to the suction throttle current regulator 83.

The regulating variable of the first high-pressure regulating loop 25 is the high pressure in the high-pressure accumulator 13. Unprocessed values of said high pressure p are measured by way of the high-pressure sensor 23 and filtered by way of a first high-pressure filter element 91, which, as output variable, has the actual high pressure $p_I$. Furthermore, the unprocessed values of the high pressure p are filtered by way of a second high-pressure filter element 93, the output variable of which is the dynamic rail pressure $p_{dyn}$. Both filters are preferably implemented by way of a $PT_1$ algorithm, wherein a time constant of the first high-pressure filter element 91 is greater than a time constant of the second high-pressure filter element 93. In particular, the second high-pressure filter element 93 is configured so as to be a faster filter than the first high-pressure filter element 91. The time constant of the second high-pressure filter element 93 may also be identical to the value zero, such that then, the dynamic rail pressure $p_{dyn}$ corresponds to, or is identical to, the measured unprocessed values of the high pressure p. Thus, with the dynamic rail pressure $p_{dyn}$, a highly dynamic value for the high pressure is available, which is in particular required whenever a fast reaction to certain occurring events is necessary.

Output variables of the first high-pressure regulating loop are thus, aside from the unfiltered high pressure p, the filtered high-pressure values $p_I$, $p_{dyn}$.

If the third logic signal SIG3 assumes the value "true", the switching element 71 switches into its lower switching position illustrated in FIG. 7. In this case, the suction throttle setpoint current $I_{S,SD}$ is no longer identical to the characteristic curve suction throttle current $I_{KL,SD}$, but rather is set equal to a suction throttle emergency current $I_{N,SS}$. The suction throttle emergency current $I_{N,SD}$ preferably has a predetermined constant value, for example 0 A, wherein then, the suction throttle 9, which is preferably open when deenergized, is opened to a maximum extent, or said suction throttle emergency current has a low current value in relation to a maximum closed position of the suction throttle 9, for example 0.5 A, such that the suction throttle 9 is opened not fully but substantially. Here, the suction throttle emergency current $I_{N,SD}$ and the associated opening of the suction throttle 9 reliably prevent the internal combustion engine 1 from coming to a standstill when it is operated in the second operation type of the protective operating mode with pressure regulating valve 19 opened to the maximum extent. Here, the opening of the suction throttle 9 has the effect that, even in a medium to low engine speed range, it is still possible for enough fuel to be delivered into the high-pressure accumulator 13 that operation of the internal combustion engine 1 is possible without stalling. In the first operation type, it is achieved in this way that twofold regulation of the high pressure both by way of the suction throttle and by way of the pressure regulating valve is prevented.

Altogether, it is evident that, with the aid of the method, the injection system 3 and the internal combustion engine 1, it is possible for stable pressure regulation to be implemented even if the first high-pressure regulating loop 25 can no longer perform the pressure regulation, wherein it is alternatively or additionally possible to omit a mechanical pressure relief valve, because the functionality thereof is performed by the pressure regulating valve 19.

The invention claimed is:

1. A method for operating an internal combustion engine having an injection system with a high-pressure accumulator, the method comprising the steps of: regulating a high pressure in the high-pressure accumulator using a low-pressure-side suction throttle as a first pressure setting element in a first high-pressure regulating loop; generating, in a normal operating mode, a high-pressure disturbance variable using of a high-pressure-side pressure regulating valve as a second pressure setting element by way of which fuel is discharged from the high-pressure accumulator into a fuel reservoir; upon failure of the first high-pressure regulating loop, setting a first operation type of a protective operating mode if the high pressure reaches or overshoots a first pressure threshold value, and regulating the high pressure using the pressure regulating valve by way of a second high-pressure regulating loop in the first operation type; and setting a second operation type of the protective operating mode if the high-pressure overshoots a second pressure threshold value, wherein in the second operation type the pressure regulating valve is permanently opened, wherein a setpoint volume flow in the normal operating mode and a setpoint flow in the protective operating mode are calculated differently.

2. The method according to claim 1, wherein, for the pressure regulating valve in the normal operating mode, and in the first operation type of the protective operating mode, a normal function is set in which the pressure regulating valve is actuated in a manner dependent on a setpoint volume flow, and, for the pressure regulating valve in the second operation type of the protective operating mode, a standstill function is set in which the pressure regulating valve is not actuated.

3. The method according to claim 1, including permanently opening the suction throttle in the second operation type and/or in the first operation type of the protective operating mode.

4. An injection system for an internal combustion engine, comprising:

a high-pressure pump;

at least one injector;

a high-pressure accumulator that is fluidically connected at one side to the at least one injector and at another side via the high-pressure pump to a fuel reservoir;

a suction throttle assigned to the high-pressure pump as the first pressure setting element;

a pressure regulating valve that fluidically connects the high-pressure accumulator to the fuel reservoir; and a control unit operatively connected to the at least one injector, to the suction throttle and to the pressure regulating valve, wherein the control unit is operative to carry out a method according to claim 1.

5. The injection system according to claim 4, wherein the pressure regulating valve is open when deenergized.

6. The injection system according to claim 4, wherein the pressure regulating valve is closed when unpressurized and deenergized, wherein said pressure regulating valve is closed when subjected to a pressure up to an opening pressure value prevailing on an inlet side, wherein said pressure regulating valve opens when the pressure prevailing on an inlet side reaches or overshoots the opening pressure value in a deenergized state.

7. The injection system according to claim 4, wherein the injection system has no mechanical pressure relief valve.

8. An internal combustion engine comprising an injection system according to claim 4.

9. A method for operating an internal combustion engine having an injection system with a high-pressure accumulator, the method comprising the steps of: regulating a high pressure in the high-pressure accumulator using a low-pressure-side suction throttle as a first pressure setting element in a first high-pressure regulating loop; generating, in a normal operating mode, a high-pressure disturbance variable using of a high-pressure-side pressure regulating valve as a second pressure setting element by way of which fuel is discharged from the high-pressure accumulator into a fuel reservoir; upon failure of the first high-pressure regulating loop due to a fault or defect in the first high-pressure regulating loop, setting a first operation type of a protective operating mode if the high pressure reaches or overshoots a first pressure threshold value, and regulating the high pressure using the pressure regulating valve by way of a second high-pressure regulating loop in the first operation type; and setting a second operation type of the protective operating mode if the high-pressure overshoots a second pressure threshold value, wherein in the second operation type the pressure regulating valve is permanently opened, wherein the fault or defect in the first high-pressure regulating loop is a failure of the suction throttle as the first pressure setting element, wherein the failure of the suction throttle is one of the group consisting of: breakage of a cable to the suction throttle plug connector, disconnection of the suction throttle plug connector, jamming of the suction throttle, and an accumulation of dirt in the suction throttle.

* * * * *